US006757939B2

(12) United States Patent
Mueller et al.

(10) Patent No.: US 6,757,939 B2
(45) Date of Patent: Jul. 6, 2004

(54) CABINET HINGE

(75) Inventors: Wolfgang Mueller, Lustenau (AT); Markus Albrecht, Lustenau (AT); Remo Egger, Bregenz (AT); Holger Wenzel, Weissensberg (AT); Johannes Haemmerle, Hoechst (AT); Juergen Amann, Lustenau (AT)

(73) Assignee: Grass GmbH, Voralberg (AT)

( * ) Notice: Subject to any disclaimer, the term of this patent is extended or adjusted under 35 U.S.C. 154(b) by 0 days.

(21) Appl. No.: 10/460,593

(22) Filed: Jun. 12, 2003

(65) Prior Publication Data

US 2003/0204934 A1 Nov. 6, 2003

Related U.S. Application Data

(62) Division of application No. 10/003,156, filed on Nov. 2, 2001, now Pat. No. 6,615,452.

(30) Foreign Application Priority Data

Nov. 2, 2000 (DE) ..... 100 54 238

(51) Int. Cl.[7] ..... E05D 7/04

(52) U.S. Cl. ..... 16/242; 16/246; 16/272; 16/236

(58) Field of Search ..... 16/242, 240, 245, 16/246, 258, 257, 271, 272

(56) References Cited

U.S. PATENT DOCUMENTS

| | | | | |
|---|---|---|---|---|
| 1,336,174 A | | 4/1920 | Way | |
| 4,142,271 A | * | 3/1979 | Busse | 16/238 |
| 4,226,591 A | | 10/1980 | Leonard | |
| 4,558,485 A | | 12/1985 | Rock et al. | |
| 4,590,641 A | | 5/1986 | Lautenschlager et al. | |
| 4,654,932 A | | 4/1987 | Rock et al. | |
| 4,691,408 A | | 9/1987 | Rock et al. | |

(List continued on next page.)

FOREIGN PATENT DOCUMENTS

| | | | |
|---|---|---|---|
| DE | 2460127 A1 | * | 6/1976 |
| DE | 2542462 A1 | * | 3/1977 |
| DE | 3348339 C2 | * | 7/1992 |
| DE | 4016664 C2 | * | 11/1993 |
| DE | 29811793 | | 12/1999 |
| DE | 29914473 | | 2/2000 |
| EP | 0969173 | | 1/2000 |
| EP | 1094183 A2 | * | 4/2001 |
| EP | 1201171 A1 | * | 5/2002 |
| GB | 2313405 A | * | 11/1997 |

*Primary Examiner*—Chuck Y. Mah
(74) *Attorney, Agent, or Firm*—John M. Harrington; Kilpatrick Stockton LLP

(57) ABSTRACT

The invention concerns a cabinet hinge with an adjusting device that is directly or indirectly on the cabinet side, single or multi-part mounting plate stored hinge arm, that is connected jointed with a door-side stop part, so that the adjusting device has a side adjusting screw by means of which the hinge arm's position perpendicular to the mounting plate can be changed to the door's side adjustment. The side adjusting device has a side adjusting screw with at least one eccentric- or cam disks so that by turning the side adjusting screw, a side adjustment and, at the same time, a parallel shifting of the hinge arm relative to the mounting plate occurs, resulting in a correction of the door's depth adjustment for an amount. The depth adjustment includes a depth adjusting screw, that is stored on the hinge arm or one of these connected assembly parts and has at least one eccentric- or cam disks that is supported on corresponding contact surfaces of the mounting plate and by turning the depth adjustment screw, a movement or shifting of the hinge arm relative to the mounting plate takes place for an amount.

8 Claims, 5 Drawing Sheets

U.S. PATENT DOCUMENTS

| | | | | | |
|---|---|---|---|---|---|
| 4,976,006 | A | | 12/1990 | Lautenschlager, Jr. | |
| 5,022,116 | A | | 6/1991 | Salice | |
| 5,025,530 | A | | 6/1991 | Ferrari et al. | |
| 5,036,565 | A | | 8/1991 | Salice | |
| 5,056,189 | A | | 10/1991 | Brustle et al. | |
| 5,062,180 | A | | 11/1991 | Lautenschlager, Jr. | |
| 5,210,907 | A | | 5/1993 | Toyama | |
| 5,245,727 | A | | 9/1993 | Sasaki | |
| 5,257,437 | A | | 11/1993 | Salice | |
| 5,412,840 | A | | 5/1995 | Lautenschlager et al. | |
| 5,511,287 | A | | 4/1996 | Lautenschlager et al. | |
| 5,577,297 | A | | 11/1996 | Lautenschlager et al. | |
| 5,781,966 | A | * | 7/1998 | Ferrari et al. | 16/242 |
| 5,930,866 | A | * | 8/1999 | Rupprechter | 16/242 |
| 5,964,011 | A | | 10/1999 | Ruston et al. | |
| 6,032,333 | A | * | 3/2000 | Brustle | 16/242 |
| 6,061,872 | A | | 5/2000 | Albrecht et al. | |
| 6,202,255 | B1 | | 3/2001 | Sitter | |
| 6,289,556 | B1 | * | 9/2001 | Salice | 16/335 |
| 6,339,864 | B1 | | 1/2002 | Albrecht et al. | |
| 6,418,589 | B1 | * | 7/2002 | Salice | 16/258 |
| 6,470,531 | B2 | * | 10/2002 | Domenig et al. | 16/240 |
| 6,523,225 | B1 | * | 2/2003 | Pecar | 16/382 |

* cited by examiner

22

CABINET HINGE

This is a division of application Ser. No. 10/003,156 filed Nov. 2, 2001 now U.S. Pat. No. 6,615,452.

FIELD OF THE INVENTION

The invention concerns a cabinet hinge with an adjusting device that is, directly or indirectly on a cabinet-sided, a single-or multi-component mounting plate stored hinge arm, according to the characterizing or introductory clause of the independent and individual patent claims.

BACKGROUND OF THE INVENTION

Generally, cabinet hinges have various adjustment possibilities.

So, an adjustment of the hinge arm's position relative to the mounting plate in the direction of the cabinet reveal (that is, a side adjustment of the cabinet door) is possible. This adjustment is achieved by the so-called side adjustment screw that is stored in the hinge arm's thread and is held by its head in a recess of the mounting plate. Depending on how the screw is turned, the hinge arm is lifted more or less from the mounting plate, resulting in a side or lateral adjustment of the cabinet door. Another possible adjustment is the hinge arm's depth adjustment, through which the cabinet door's distance is adjusted to the front of the cabinet. The depth adjustment can generally be accomplished by a locking screw, by which the hinge arm is fastened on the mounting plate. The locking screw projects through a slot in the hinge arm; the depth can be adjusted by sliding the screw along the slot and the length of the slot determines the depth adjustment.

A cabinet hinge of the type named above is made known by DE 298 11 793 U1.

The known adjusting devices have, however, considerable disadvantages.

With reference to the side adjustment of the doors, the hinge arm swings around an imaginary axis when the side adjusting screw is turned, so that the adjustment movement results along an arc. Not only is the side position of the door adjusted, but also the door's depth position is unintentionally adjusted, changing the door's distance from the front edge of the cabinet.

The problem with the depth adjustment is that the depth adjusting screw must be loosened in order to allow it to slide along the slot. A slight adjustment is not possible in this manner.

A hinge that has the equalizing function of the side adjustment is described in DE 299 14 473 U1. At least one pivoting lever swings or rotates when the side adjusting screw is turned or swiveled and is supported directly or indirectly on the hinge arm, so that when the reveal adjusting screw is turned, the hinge arm is guided by at least one pivot lever that is parallel to the baseplate. The design shown here appears, however, to be very expensive and complex to produce.

SUMMARY OF THE INVENTION

The task of the invention is to propose a cabinet hinge that has improved adjustment possibilities without incurring excessive design and manufacturing expenditures.

The solution of this task results from the features and characteristics of the independent and individual patent claims.

To achieve the side adjustment, the side adjusting screw has at least one eccentric or cam disk, so that when the side adjusting screw is turned, it causes a side adjustment, as well as a parallel sliding of the hinge arm relative to the mounting plate, and with it, a correction of the door's depth adjustment around an amount K.

The invention has the advantage that when the hinge with the depth adjusting device is installed, the set gap width S says constant, even when one varies the reveal width F with the side adjusting device.

The side adjusting screw sits with its thread in a corresponding thread bore hole of hinge arm.

The eccentric disk works together with a bearing plate that is located, relative to the mounting plate, securable between the hinge arm and the mounting plate. The bearing plate includes an eccentric bearing, which supports itself on the eccentric disk, so that when the side adjusting screw is operated, a side adjustment results perpendicular to the hinge arm's assembly plane surface and causes the hinge arm's sliding on the bearing plate, as well as the mounting plate. In another preferred embodiment, the side adjusting screw has two somewhat opposite-running, overlapping cam disks.

The bearing plate has an opening that forms the contact surfaces for both cam disks.

For this, the bearing plate has a bend, which emerges in two levels overlapping contact surfaces for the cam disks.

Because of the opposing cam disks, there is approximately doubled the adjusting distance as opposed to the utilization of only one cam disk.

In order to achieve one of the sides adjusting distance's conformed depth correction of the hinge arm, the eccentricity of the eccentric or cam disk is matched to the pitch of the side adjusting screw's thread.

For the depth adjustment, the depth adjusting screw is located on the hinge arm or on one of these connected component parts and has at least one eccentric or cam disk that supports itself on corresponding contact surfaces of the mounting plate, and when the depth adjusting screw is turned, a shifting of the hinge arm, relative to the mounting plate, occurs around an amount W.

This results in the advantage that when the hinge is installed by means of the depth adjusting screw, the gap width S can be set quickly, precisely and sensitively. With that state of technology, it was usual that the depth adjusting screw was formed as in an elongated running locking screw that had to be loosened so that the hinge arm could be adjusted.

Furthermore, the mounting plate preferably includes a baseplate and an adjusting plate so that the adjusting plate can be releasable with the baseplate.

Preferably, the depth adjusting screw had two somewhat opposing overlapping cam disks. The opposing cam disks allow approximately a doubling of the adjusting distance, as opposed to using only one cam disk.

The depth adjusting screw, which can be pivoted, is stored in a bearing plate and engages through an available opening in the adjusting plate, forming the contact surfaces for the cam disk(s) of the depth adjusting screw. So that suitable contact surfaces are available for both cam disks, the adjusting plate includes a bend, which emerges into two levels overlapping contact surfaces for the cam disks.

This way, by operating the depth adjusting screw, the bearing plate and with it, the connected hinge arm, can be shifted opposite the adjusting plate.

Preferably, the bearing plate includes bearing tabs that engage in corresponding hinge arm's glide slits and are guided, movable, in these. The bearing tabs also work as a pivot bearing, about whose axis the hinge arm rotates during a side adjustment.

Subsequently, several embodiments of the invention are more closely described on the basis of drawing representations. Further characteristics, advantages and uses of the invention result from the drawings and their descriptions.

BRIEF DESCRIPTION OF THE DRAWINGS

FIG. 2: a section through the side-adjusting device in the first position;

FIG. 3: a section through the side-adjusting device in a second position;

DETAILED DESCRIPTION

Figure 1:
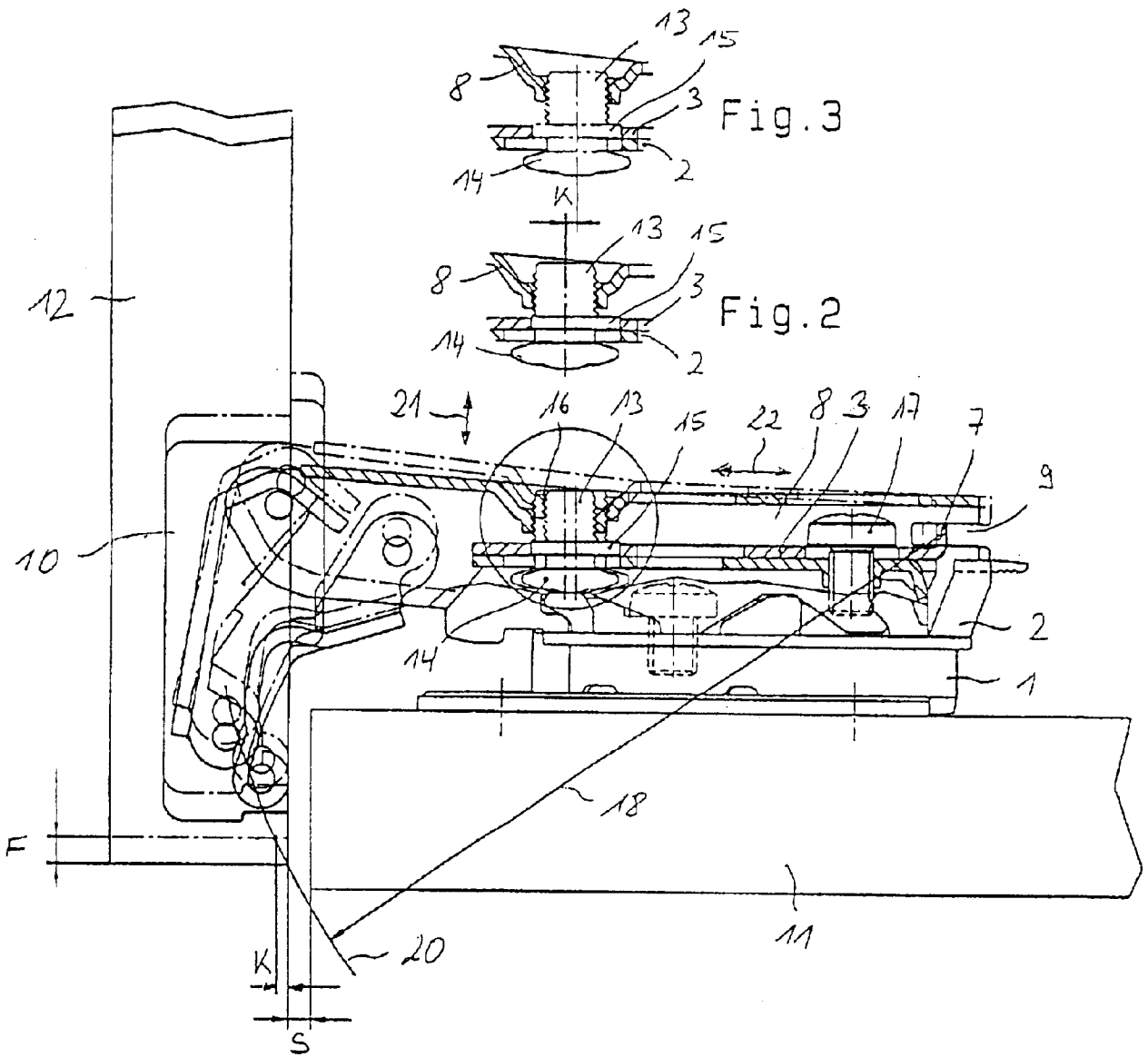
FIG. 1: a longitudinal section through a first embodiment of the invention-related cabinet hinge.

A first example of the invention's embodiment is represented in FIGS. 1 to 7A.

The cabinet hinge includes a mounting plate, consisting of a baseplate (1) and an adjusting plate (2); the baseplate (1) is fastened on the side wall of the cabinet case (11). The adjusting plate (2) can be connected, attachable and releasable, to the baseplate (1). The hinge arm (8) is fastened on the adjusting plate (2) and, as shown in the drawing, continues left and is connected, jointed, with a stop component on the door's side (for example, a hinge cup [10 ]), which is recessed in the cabinet door (12). A side adjusting screw (13) is provided in order to adjust the cabinet door (12) laterally (that is, to adjust the hinge arm [8 ]) in the direction of the mounting level, as well as the baseplate (1).

The depth adjustment and, also, the hinge arm's (8) adjustment parallel to the baseplate (1), results by means of a depth adjusting screw (17), whose thread engages in a corresponding receptacle thread in the adjusting plate (2). If the depth adjusting screw's (17) seat is loosened somewhat, the hinge arm (8) can be pushed in the arrow direction (22) until the gap S reaches the desired result. Tightening the depth adjusting screw (17) then fixes the hinge arm (8) in the pre-set position.

Figures 4, 5, 6, 7, 7A:
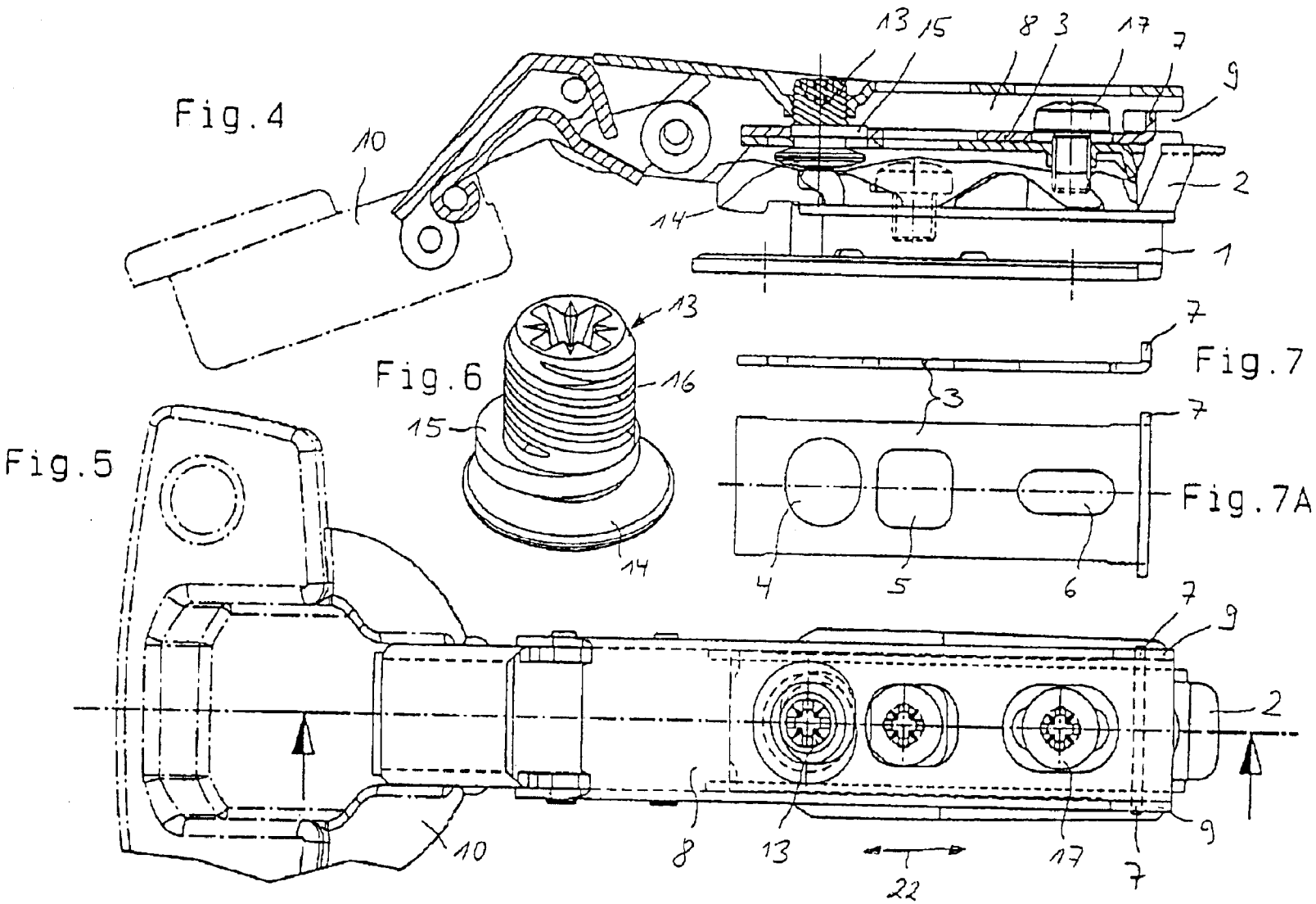
FIG. 4: a longitudinal section through the first embodiment of the cabinet hinge.
FIG. 5: an overview of the first embodiment of the cabinet hinge, according to FIG. 4.
FIG. 6: a perspective view of the side adjusting screw.
FIG. 7: a side view of the bearing plate.
FIG. 7A: an overview of the bearing plate, according to FIG. 7.
Figures 8, 9, 10, 10A:
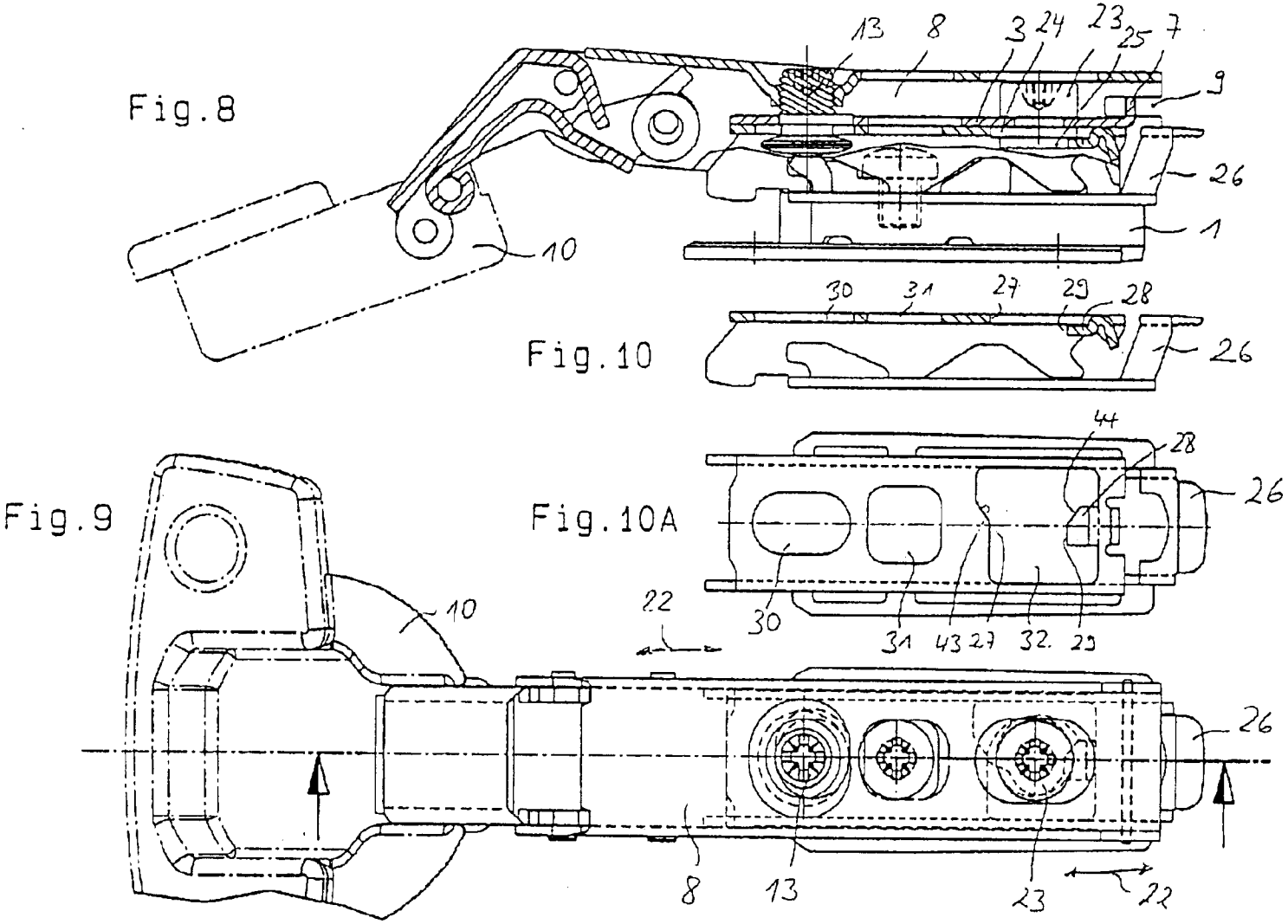
FIG. 8: a longitudinal section through a second embodiment of the invention-related cabinet hinge.
FIG. 9: an overview of the second embodiment of the cabinet hinge according to FIG. 8.
FIG. 10: a side view of the adjusting plate.
FIG. 10A: an overview of the adjusting plate.
Figure 12:
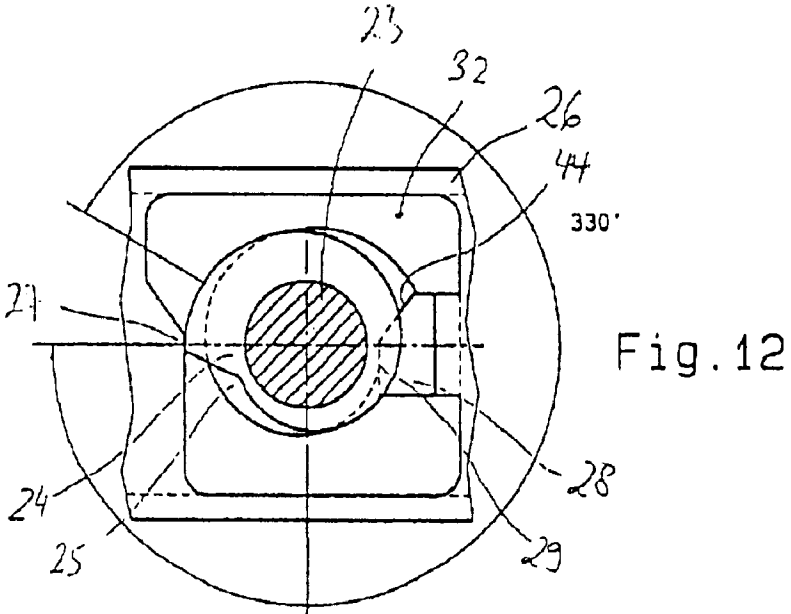
FIG. 12: an overview of the depth-adjusting device in a first position.
Figure 12A:
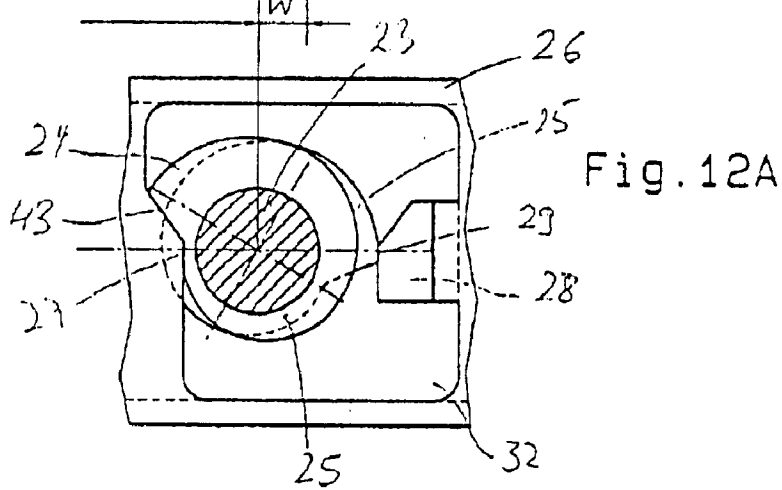
FIG. 12A: an overview of the depth-adjusting device in a second position.

The side adjusting screw (13), shown in FIG. 6, lays with its thread (16) in the hinge arm's (8) thread bore hole and is supported with its screw head (14) on a corresponding contact surface of the adjusting plate (2). Turning the side adjusting screw (13) allows the hinge arm (8) to be adjusted in the arrow direction (21); for example, right turn in a position, as is represented with dotted lines in FIG. 1.

In this manner, the cabinet door (12) slides upward in the arrow direction (21); the reveal F increases. Now because the hinge arm (8) with the side adjustment now does not operate with a pure lifting motion, but instead a swinging or pivot motion, a circular movement takes place around an imaginary axis with the center around the reference number 7, so that the adjusting motion takes place along an arc 20 with a radius 18. Not only is there an adjustment of the reveal width F, but simultaneously, an undesirable enlargement of the gap S takes place around the K amount.

This undesirable depth adjusting movement is counteracted by the invention in that the side adjusting screw (13) has an eccentric disk (15), which works together (FIG. 6) with an eccentric plate (4) in a bearing plate (3). The bearing plate (3), shown in FIGS. 7 and 7A, is located between the hinge arm (8) and the adjusting plate (2) and is normally connected firmly by the clamping action of the depth adjustment screw (17) to the adjusting plate (2). The hinge arm (8) can, however, be glided-movable-in arrow direction 22 on the bearing plate (3), through one side adjusting screw (13) and to the other through the side slit (9) in the hinge arm (8) in which corresponding bearing tabs (7) of the bearing plate (3) engage so that a shifting in arrow direction (22), as well as a swinging motion around the bearing tab's (7) axis, is possible.

The side adjusting screw (13), which can be pivoted, is placed in the adjusting plate (2) and is supported with its head (14) on a contact surface of the adjusting plate (2). The eccentric disk (15) works together with the eccentric bearing (4) of the bearing plate (3), so that the eccentric disk (15) takes a base position as is shown in FIG. 2. Then a turning motion of the side adjusting screw (13) to the right takes place; because of the thread (16) the hinge arm (8) is lifted up and, simultaneously, moves the eccentric disk (15) into a position (as shown in FIG. 3); whereby, the side adjusting screw (13) is shifted to the right together with the hinge arm (8) in the illustration around an amount K. This amount corresponds exactly to the amount K in FIG. 1; that is, the unwanted increase of the gap S around the amount K is counteracted and corrected by the eccentric placement of the side adjusting screw (13).

A second embodiment of the invention is represented in FIGS. 8 to 12A. The side adjustment that occurs with the side adjusting screw (13) and bearing plate (3) is identical to the side adjustment depicted with FIGS. 1 to 7.

Figure 11:
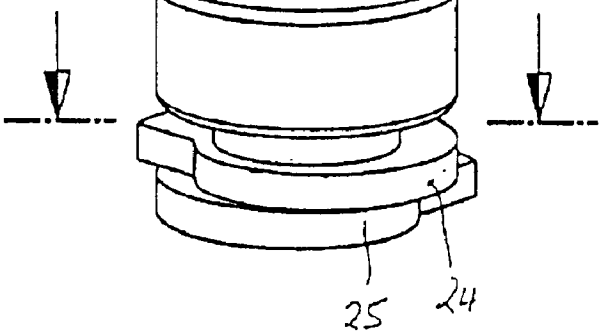
FIG. 11: a perspective view of the depth adjusting screw.

The depth adjustment now has a particular depth adjusting screw (23) that is more closely illustrated in FIG. 11. The depth adjusting screw (23) includes two overlapping cam disks (24 and 25), that work together with the contact surfaces located in the adjusting plate (26). With this, the adjusting plate (26), shown in FIGS. 10 and 10A, has a special opening (32) that forms contact surfaces (27 and 29)

for the upper and lower cam disks (24, 25). So that the contact surfaces (27, 29) always lie in the level of the corresponding cam disk, the adjusting plate (26) includes a downward bend (28), which forms the lower contact surface (29). Stops (43, 44) are attached to the contact surfaces (27, 29) which serve as stop limit restrictions for the depth adjusting screw (23). The operation of the adjustment is more closely shown in FIGS. 12 and 12A. The lower cam disk (25) of the depth adjusting screw (23) is supported in the position, according to FIG. 13, at the stop (44) of the bend (28), as well as lying on this. Simultaneously, the upper cam disk (24) lies with its circumferential surface on the left stop (27) of the adjusting plate (26). The adjusting plate (26) is fixed opposite the baseplate (1), so that—as has already been executed—the bearing plate (3), together with the hinge arm (8), can be shifted opposite the adjusting plate (26) in arrow direction 22. Now the depth adjusting screw (23) is turned left so that the circumferential surface of the lower cam disk (25) glides along the contact surface (29) and pushes itself there so that the bearing plate (3), together with the depth adjusting screw (23) and the hinge arm (8), moves left about an amount W so that the depth adjusting screw can be turned until the upper cam disk (24) comes into contact with stops (43). In the same way, turning the depth adjusting screw (23) left makes the upper cam disk (24) come into contact with the contact surface (27) so that the depth adjusting screw (23), together with the hinge arm (8), moves right again about the amount W, until the lower cam disk (25) comes into contact with the stop (44). Consequently, an easy, precise and delicate depth adjustment can be achieved.

Figures 13, 14, 15, 16, 16A:
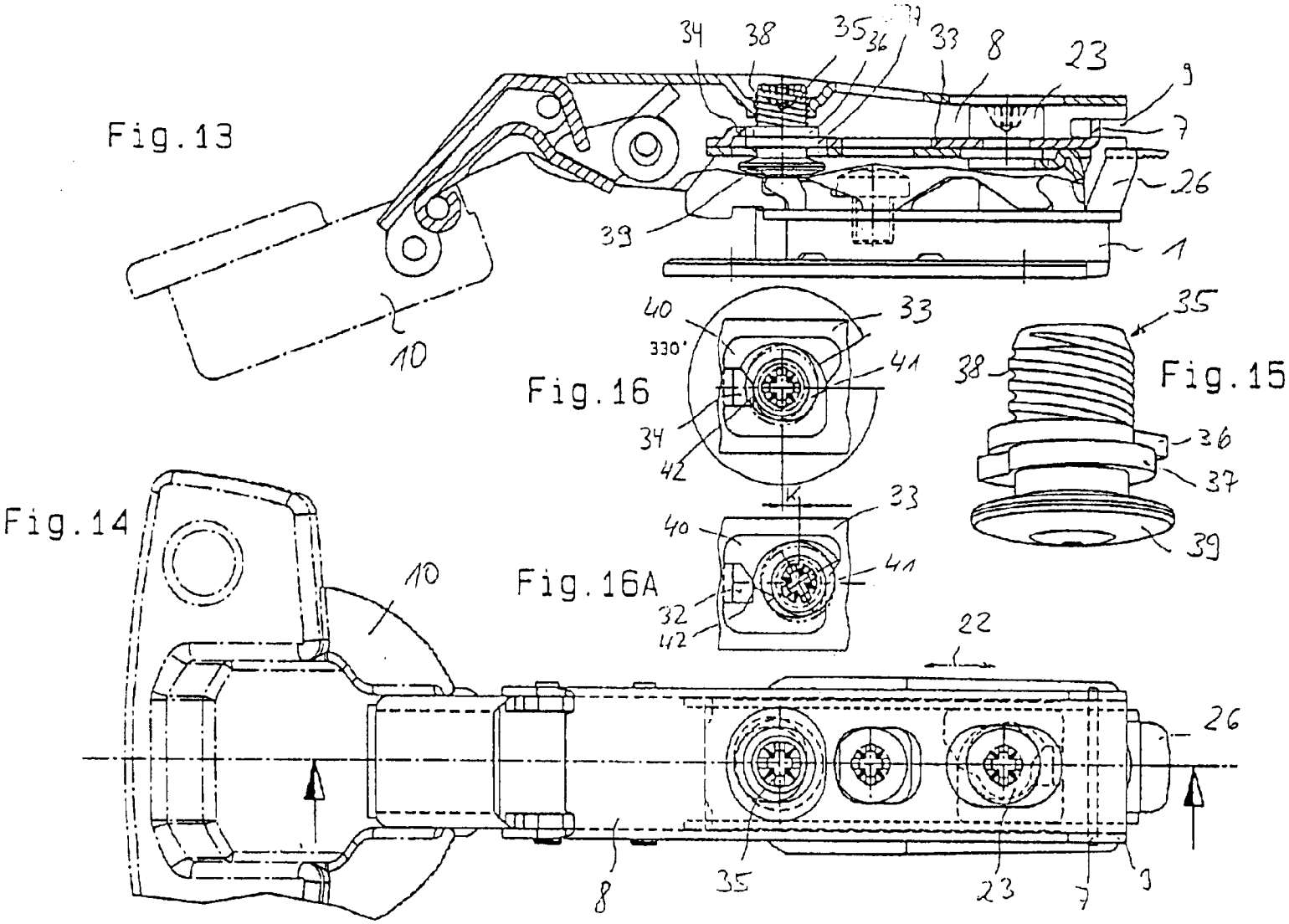
FIG. 13: a longitudinal section through a third embodiment of the invention-related cabinet hinge.
FIG. 14: an overview of the third embodiment of the cabinet hinge according to FIG. 13.
FIG. 15: a perspective view of the side adjusting screw.
FIG. 16: an overview of the side-adjusting device in a first position.
FIG. 16A: an overview of the side adjusting device in a second position.

A third embodiment of the invention is represented in FIGS. 13 to 16A. The depth-adjusting device with the depth adjusting screw (23) is identical to the depth-adjusting device that is described in context to the FIGS. 8 to 12A. The side-adjusting device includes an invention-related side adjusting screw (35) that, in accordance to FIG. 15, is now equipped with two cam disks (36,37), similar to the depth adjusting screw (23). The side adjusting screw (35) sits again with its thread (39) in the hinge arm (8) and is supported with its screw head (39) on the corresponding surface of the adjusting plate (26). Suitable contact surfaces for the cam disks (36, 37) of the side adjusting screw (35) are formed by a modified bearing plate (33), which approximates the design of the bearing plate (3), according to FIGS. 7 and 7A; however, the side adjusting screw's (35) area has an opening (40) that has contact surfaces (41, 42) for the lower and upper cam disks (36, 37) of the side adjusting screw (35). In order to put the contact surfaces in two levels against each other, a bend (34) projects in the opening (40), which forms the upper contact surface (42).

In contrast to the embodiment example of a side adjustment, according to FIGS. 1 through 8, a more delicate adjustment by the double cam disks of the side adjusting screw (35) is possible with less effort because of the rise or pitch of the side adjusting screw (35) by the bigger adjustment of the double cam disks can be essentially made smaller, as comparatively shown in the example, according to FIGS. 1 to 8. If the side adjusting screw (35) is now operated, the hinge arm (8) lifts up in a corresponding manner from the adjusting plate (26), so that simultaneously, the cam disks causes a shifting movement of the bearing plate (33), together with the hinge arm (8), in order to cause the amount K so that a balance results for the normally undesirable modification of the gap S (FIG. 1).

| Drawing Legend | |
|---|---|
| 1. | Baseplate |
| 2. | Adjusting plate |
| 3. | Bearing plate |
| 4. | Eccentric bearing |
| 5. | Opening |
| 6. | Slot |
| 7. | Bearing tab |
| 8. | Hinge arm |
| 9. | Glide slit |
| 10. | Hinge cup |
| 11. | Cabinet side wall |
| 12. | Cabinet door |
| 13. | Side adjusting screw |
| 14. | Screw head |
| 15. | Eccentric disk |
| 16. | Thread |
| 17. | Depth adjusting screw |
| 18. | Radius |
| 19. | Fulcrum |
| 20. | Arc |
| 21. | Arrow direction |
| 22. | Arrow direction |
| 23. | Depth adjusting screw |
| 24. | Cam disk |
| 25. | Cam disk |
| 26. | Adjusting plate |
| 27. | Contact surface |
| 28. | Bend |
| 29. | Contact surface |
| 30. | Slot |
| 31. | Opening |
| 32. | Opening |
| 33. | Bearing plate |
| 34. | Bend |
| 35. | Side adjusting screw |
| 36. | Cam disk |
| 37. | Cam disk |
| 38. | Thread |
| 39. | Screw head |
| 40. | Opening |
| 41. | Contact surface |
| 42. | Contact surface |

What is claimed is:

1. A cabinet hinge with an adjusting device that is mountable on a cabinet side, comprising:

a mounting plate;

a hinge arm supported on the mounting plate and fastened in a jointed manner with a door-side stop part;

a depth adjusting screw rotatably received in a bearing plate disposed between the hinge arm and the mounting plate for selectively adjusting a position of the hinge arm relative to the mounting plate in a direction longitudinally of the mounting plate; the depth adjusting screw comprising two overlapping cam disks that are cooperatively engageable to two corresponding contact surfaces of the mounting plate, wherein rotating the depth adjusting screw activates a shifting of the hinge arm relative to the mounting plate thereby adjusting the position of the hinge arm relative to the mounting plate in said direction longitudinally of the mounting plate.

2. The cabinet hinge, according to claim 1, wherein the bearing plate is moveable relative to at least one of the hinge arm and the mounting plate.

3. The cabinet hinge, according to claim 1, wherein the mounting plate comprises an adjusting plate adjacent the bearing plate and a base plate adjacent the adjusting plate.

4. The cabinet hinge, according to claim 3, wherein the adjusting plate of the mounting plate further comprises an opening formed therein with portions that form one of the corresponding contact surfaces of the mounting plate for one of the two overlapping cam disks.

5. The cabinet hinge, according to claim 4, wherein the adjusting plate further comprises a bend, which forms a second, overlapping one of the corresponding contact surfaces for a second one of the overlapping cam disks.

6. The cabinet hinge, according to claim 1, wherein the two overlapping cam disks of the depth adjusting screw have circumferential cam surfaces running in different directions.

7. The cabinet hinge, according to claim 1, further comprising a side adjusting screw, the side adjusting screw comprising a thread section received in the hinge arm and supported on the mounting plate for selectively adjusting a position of the hinge arm relative to the mounting plate in a direction perpendicular to the mounting plate and at least one cam disk for simultaneously adjusting a position of the hinge arm relative to the mounting plate in a direction longitudinally of the mounting plate.

8. The cabinet hinge, according to claim 1, wherein the bearing plate has a pair of bearing tabs that pivotably and slideably engage in a corresponding glide slit of the hinge arm.

* * * * *

UNITED STATES PATENT AND TRADEMARK OFFICE

CERTIFICATE OF CORRECTION

PATENT NO. : 6,757,939 B2 
DATED : July 6, 2004
INVENTOR(S) : Wolfgang, Mueller et al.

It is certified that error appears in the above-identified patent and that said Letters Patent is hereby corrected as shown below:

Column 7,
Line 6, "faces for a second one of the overlapping cam disks," should read -- faces for a second one of the two overlapping cam disks --.

Signed and Sealed this

First Day of February, 2005

JON W. DUDAS
*Director of the United States Patent and Trademark Office*